US006302177B1

(12) United States Patent
Gruber

(10) Patent No.: US 6,302,177 B1
(45) Date of Patent: Oct. 16, 2001

(54) TAPE DISPENSER SYSTEM

(76) Inventor: George Gruber, 17823 Pawnee Ave. North, Stillwater, MN (US) 55082

( * ) Notice: Subject to any disclaimer, the term of this patent is extended or adjusted under 35 U.S.C. 154(b) by 0 days.

(21) Appl. No.: 09/374,406

(22) Filed: Aug. 13, 1999

(51) Int. Cl.[7] ..... B32B 31/00

(52) U.S. Cl. ..... 156/527; 156/577; 156/579; 242/588.2; 242/588.6

(58) Field of Search ..... 156/523, 527, 156/574, 577, 579; 242/588.1, 588.2, 588.6

(56) References Cited

U.S. PATENT DOCUMENTS

| | | | | |
|---|---|---|---|---|
| 3,187,968 | * | 6/1965 | Favre | 225/56 |
| 3,318,753 | | 5/1967 | Whitlow | 156/461 |
| 3,364,096 | | 1/1968 | Hetes | 156/577 |
| 3,523,053 | * | 8/1970 | Zbinden et al. | 156/523 |
| 3,537,942 | | 11/1970 | Kefalos | 156/577 |
| 3,666,601 | | 5/1972 | Wuerch | 156/527 |
| 3,730,815 | | 5/1973 | Terzian | 156/527 |
| 3,740,297 | | 6/1973 | Vidinsky | 156/523 |
| 4,067,510 | | 1/1978 | McGonagle | 242/55.2 |
| 4,096,021 | | 6/1978 | Pool et al. | 156/527 |
| 4,238,271 | * | 12/1980 | Urushizaki | 156/523 |
| 4,253,905 | | 3/1981 | Regan | 156/523 |
| 4,357,198 | | 11/1982 | Ezquerro | 156/391 |
| 4,379,019 | | 4/1983 | Pool | 156/527 |
| 4,508,587 | | 4/1985 | Hunter | 156/527 |
| 4,511,427 | | 4/1985 | Karliner et al. | 156/523 |
| 4,667,891 | | 5/1987 | Pool | 242/75.4 |
| 4,818,329 | | 4/1989 | Tutas et al. | 156/391 |
| 4,915,768 | | 4/1990 | Soderberg | 156/527 |
| 4,981,537 | | 1/1991 | Heil et al. | 156/71 |
| 5,037,501 | | 8/1991 | Lawson | 156/527 |
| 5,269,871 | | 12/1993 | Longworth et al. | 156/527 |
| 5,316,614 | | 5/1994 | Phillips | 156/574 |
| 5,445,703 | | 8/1995 | Steeves et al. | 156/544 |
| 5,641,109 | * | 6/1997 | Willoughby | 242/588.1 X |
| 5,800,668 | * | 9/1998 | Bumb | 156/577 |

FOREIGN PATENT DOCUMENTS

| | | | |
|---|---|---|---|
| 0653368A1 | 9/1994 | (EP) | B65H/37/00 |
| WO 93/09050 | 5/1993 | (WO) . | |

* cited by examiner

*Primary Examiner*—Mark A. Osele
(74) *Attorney, Agent, or Firm*—Nikolai & Mersereau, P.A.

(57) ABSTRACT

A tape dispenser that dispenses and applies tape to a first surface, wherein an edge of the tape is precisely positioned either flush or a predetermined distance from an adjacent second surface. The tape dispensing system of the present invention allows for bi-directional application of tape to the first surface and is particularly well suited for applying tape both around and into corners. The tape dispenser system further provides for an automatic alignment of an outer edge of a roll of tape relative to the dispenser frame independent of the thickness of the roll of tape.

34 Claims, 13 Drawing Sheets

TAPE DISPENSER SYSTEM

BACKGROUND OF THE INVENTION

I. Field of the Invention

This invention relates generally to devices for dispensing a continuous strip of tape and more particularly relates to a tape dispenser that dispenses and applies tape to a first surface, wherein an edge of the tape is precisely positioned either flush or a predetermined distance from an adjacent second surface. The tape dispensing system of the present invention allows for bi-directional application of tape to the first surface and is particularly well suited for applying tape both around and into corners. The tape dispenser system further provides for an automatic alignment of an outer edge of a roll of tape relative to the dispenser frame independent of the thickness of the roll of tape.

II. Discussion of the Related Art

At various times it is desirable to precisely apply a strip of tape to a first surface, such as a baseboard, wherein an edge of the strip of tape is consistently spaced a predetermined distance from an adjacent second surface, such as a wall. For ease of discussion and without limitation, the first surface will be referred to herein as a baseboard or other trim and the second adjacent surface will be referred to herein as a wall. Although the user may manually remove a strip of tape from a roll of tape and then apply this strip to an edge of the baseboard adjacent the wall, the removal and alignment process is time consuming and imprecise. It has been found to be both desirable and efficient to apply a strip of tape to the baseboard from a tape applicator or dispenser.

In the past, tape applicators have been provided that apply tape to a baseboard, for example, requiring manual alignment of the tape's edge to the adjacent wall. G. J. Kefalos in U.S. Pat. No. 3,537,942 describes a tape applicator having a hub and cylindrical alignment roller that may be used to apply tape to a baseboard adjacent a wall. The hub is adapted for receiving a roll of tape, wherein the roll of tape is pressed onto the hub until an inner edge of the roll of tape engages against a rear flange of the hub. The user must then manually adjust the alignment roller such that the outer edge of the alignment roller aligns with the outer edge of the roll of tape. Each time a new roll of tape is engaged to the hub, the alignment roller should be accordingly adjusted. Apparently, the dispenser described by Kefalos allows the user to apply tape to the baseboard with an edge of the tape positioned flush with the wall. It is desirable, however, to eliminate the need for manual adjustments of an alignment member each time a roll of tape is replaced. The tape applicator described by Kefalos is further limited in its ability to apply tape into a corner section, around corner edges. Further, the device described by Kefalos is limited in that it is designed to apply tape to a surface in only one direction.

A. E. Vidinsky in U.S. Pat. No. 3,740,297 describes a masking tape applicator capable of applying tape into a corner. Vidinsky describes a device having three rollers that act to align the masking tape during application. A roll of tape is loaded onto a spool, pressing an inner side of the roll of tape against a flange of the spool, such that outer ends of the three rollers extend slightly beyond the outside edge of the tape. In order to accommodate rolls of masking tape of various widths, Vidinsky describes the use of spacers having various thickness engaged between an inner edge of the roll of tape and the spool flange. The manual replacement of spacers for each roll of tape is time consuming and use of spacers may make it difficult to achieve precise alignment between the rollers and the outer edge of the tape. Further, when applying tape with the device described by Vidinsky, the device is only operable in one direction.

Longworth, et al. in U.S. Pat. No. 5,269,871 describes a tape applicator having a complex alignment and cutting mechanisms. The device described by Longworth et al. also apparently requires engaging the inner edge of a roll of tape to a flange of a hub adapted for receiving the roll of tape, wherein a manually adjustable means positions the flange at different desired axial positions to thereby position the sides of different width rolls of tape in a desired orientation with respect to the distal ends of application rollers. For the reasons indicated above, among other, a dispenser requiring manual adjustment for each new roll of tape is not preferred. Further, although the device described by Longworth, et al. appears to be operable in either direction, the device is not particularly well suited for applying tape into or around corners. Hence, there is a need for a device that automatically aligns the outer edge of a roll of tape without requiring manual adjustment when switching between widths of tape and wherein the device is well suited for taping in and around corners. The present invention meets these and other needs that will become apparent from a review of the description of the present invention.

SUMMARY OF THE INVENTION

The present invention provides a portable bi-directional tape dispensing device capable of conveniently and effectively applying pressure sensitive adhesive coated tape around and into corners and along narrow edge surfaces, wherein the application surface may be adjacent to a second surface, such as a wall or framework. The tape-dispensing device further provides for an automatic alignment of an outer edge of the roll of tape relative to a frame of the dispensing device, wherein the automatic alignment is independent of the thickness of the roll of tape.

The tape-dispensing device of the present invention generally includes a frame, a hub and an application roller. The hub is rotatably attached to the frame and is adapted for receiving the role of tape. The application roller assists in guiding the tape out of the dispenser as tape is applied to a surface. Without limitation, in the preferred embodiment the application roller is rotatably attached to the frame, however, it is recognized that the application roller may be rigidly engaged or formed as part of the frame. The dispensing device includes at least one alignment member, wherein the outer edge of the alignment member and the outer edge of the roll of tape are aligned in the same plane. Those skilled in the art will appreciate that the application roller may act as the alignment member or one or more separate independent alignment members may extend from the frame. In use, the user preferably places the roll of tape on a flat surface, aligns the hub with the core bore of the role of tape, and then presses the hub into the core bore until the alignment member engages the flat surface. In this manner, the outer edge of the roll of tape and alignment member are aligned independent of the width of the role of tape and without requiring manual adjustments of the alignment member relative to the frame.

Without any limitation intended, the preferred embodiment of the dispensing device of the present invention is manufactured from a high impact thermal moldable plastic of known suitable composition and includes two spaced apart alignment members, wherein the application roller is coupled to the dispenser frame between the two alignment members. An angle between the longitudinal axis extending from the first alignment member to the application roller and the longitudinal axis extending from the second alignment member to the application roller is ninety (90) degrees or less. This arrangement provides for a smooth transition in directions when applying the tape into and around corners.

The dispensing device includes a means for holding said dispensing device while dispensing tape there from. Although it is recognized that the means for holding may include a handle attached to a side or end of the dispenser, fingerholds are preferably formed integral with the frame. The fingerholds provide a holding and gripping surface and allows for efficient rotation and other manipulation of the orientation and movement of the dispenser.

In an alternate embodiment of the present invention, bristles are attached to the frame, wherein the bristles apply pressure to the tape as tape is being dispensed from the dispensing device. In another alternate embodiment the hub includes a spring biasing member coupled to the hub. The spring biasing member provides for lateral movement of the hub relative to a longitudinal axis of the frame and/or alignment member. At times, when applying tape to a baseboard or wallboard, the user may wish to have the tape overlap slightly onto the adjacent wall or may desire to have a slight space (of a few thousandths of an inch) between the edge of the tape and the wall. In either instance, the spring biasing member may be utilized to adjust the hub inward or outward.

OBJECTS

It is accordingly a principal object of the present invention to provide a tape dispenser that dispenses and applies tape to a first surface, wherein an edge of the tape is precisely positioned either flush or a predetermined distance from an adjacent second surface.

Another object of the present invention is to provide a tape dispenser that allows for bi-directional application of tape to a first surface.

A further object of the present invention is to provide a tape dispenser that is capable of applying tape both around and into corners in either direction.

Still another object of the present invention is to provide a tape dispenser system that provides for an automatic alignment of an outer edge of a roll of tape relative to the dispenser frame independent of the thickness of the roll of tape.

These and other objects and advantages of the present invention will become readily apparent to those skilled in the art from a review of the following detailed description of the preferred embodiment especially when considered in conjunction with the claims and accompanying drawings in which like numerals in the several views refer to corresponding parts.

DESCRIPTION OF THE PREFERRED EMBODIMENT

The present invention represents broadly applicable improvements to dispensers for applying tape to a desired surface. Those skilled in the art will appreciate that the manner of using the tape dispensing device of the present invention and the particular use or application will vary from user to user. Thus, the description herein of applying tape to a wall, baseboard or framework should not be deemed as limiting the device to a particular use or purpose. Also, the embodiments detailed herein are intended to be taken as representative or exemplary of those in which the improvements of the invention may be incorporated and are not intended to be limiting.

Figure 1:
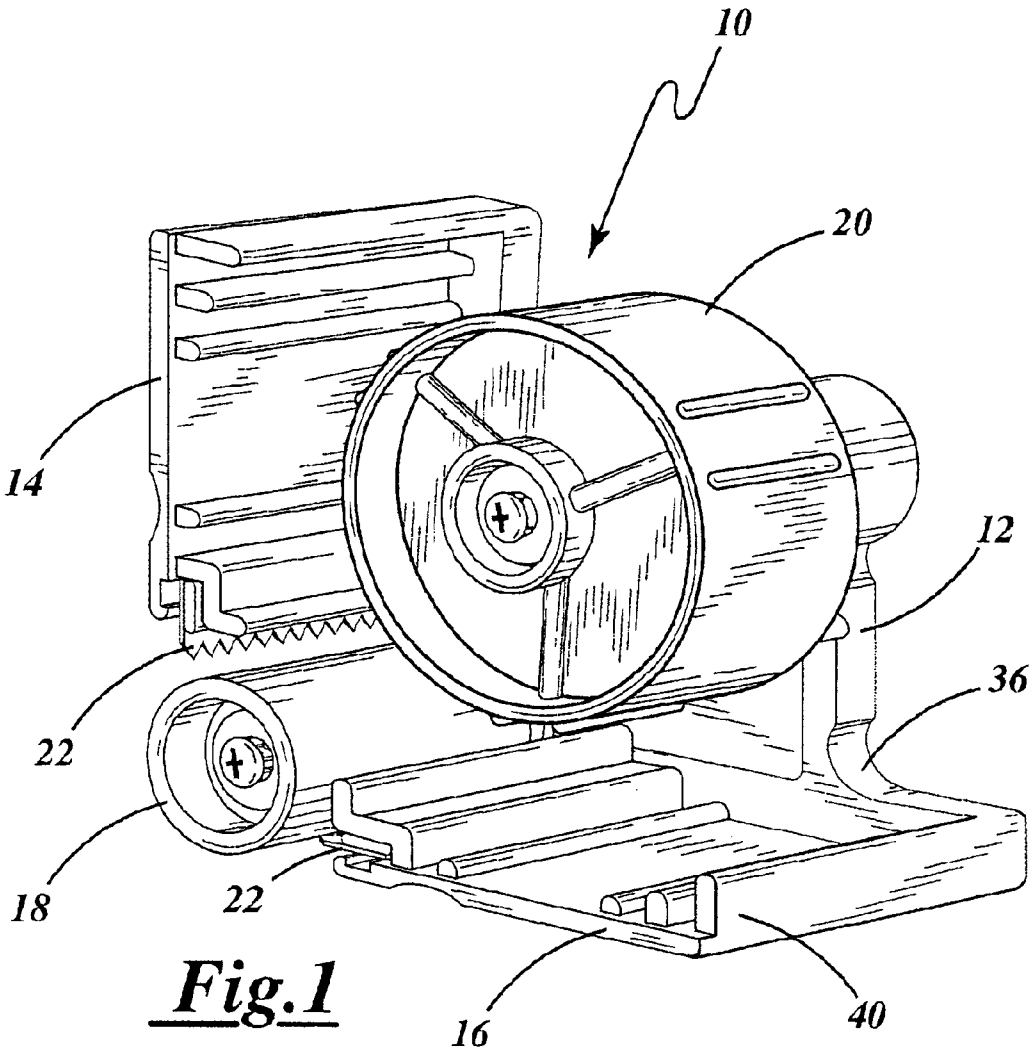
FIG. 1 is a front perspective view of the tape dispenser system of the present invention.
Figure 2:
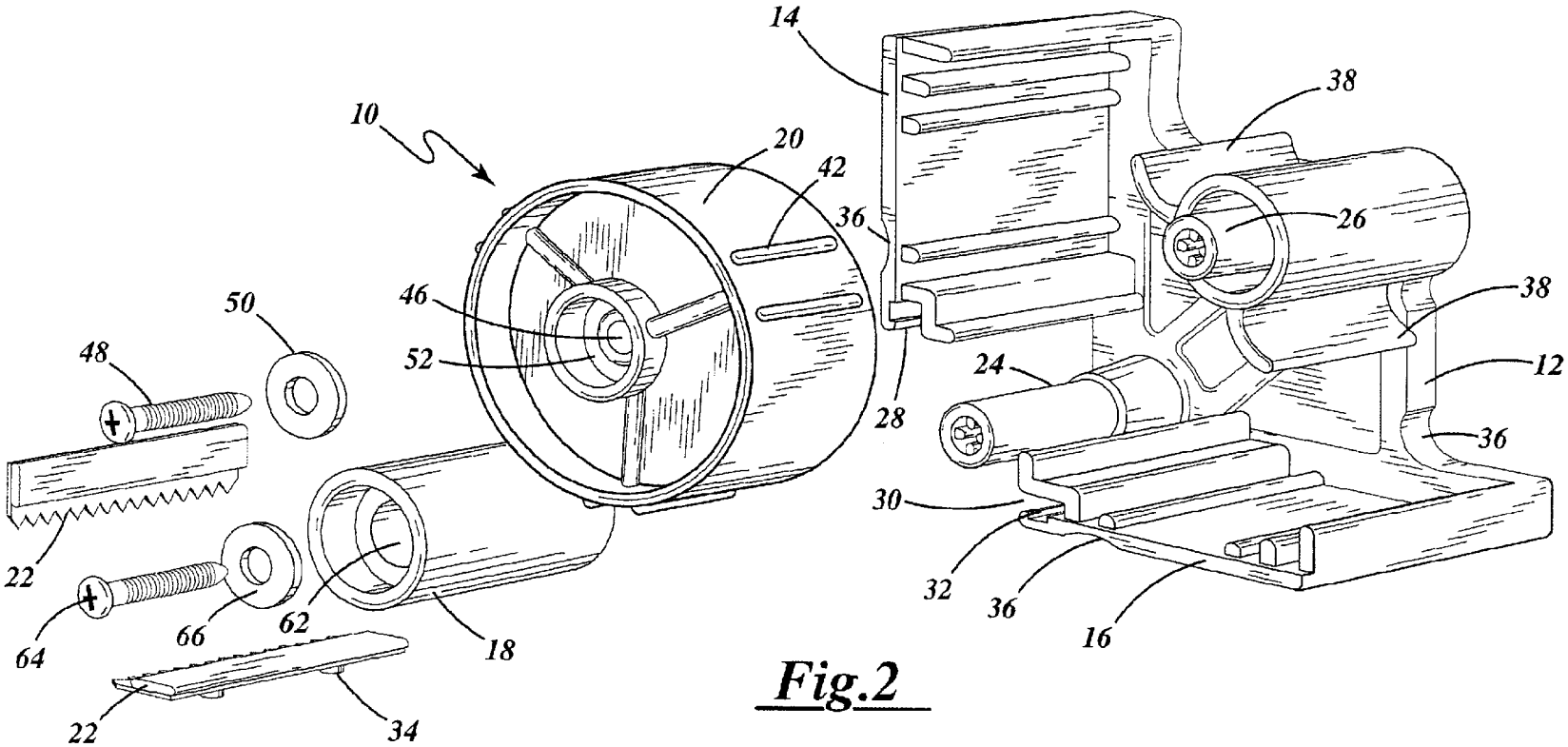
FIG. 2 is a front exploded perspective view of the tape dispenser system of the type shown in FIG. 1.
Figure 4:
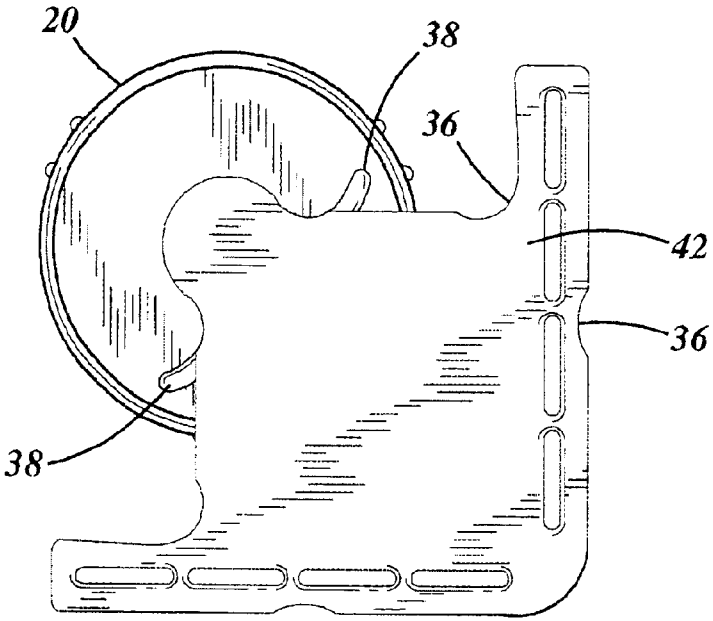
FIG. 4 is a back elevational view of the tape dispensing system of the type shown in FIG. 1.
Figure 3:
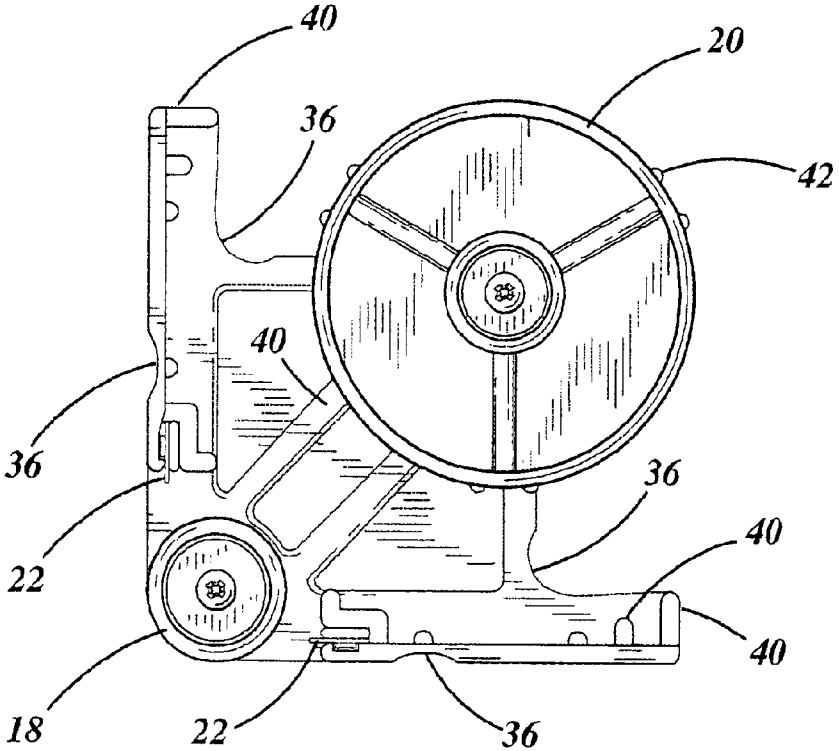
FIG. 3 is a front elevational view of the tape dispensing system of the type shown in FIG. 1.
Figure 7:
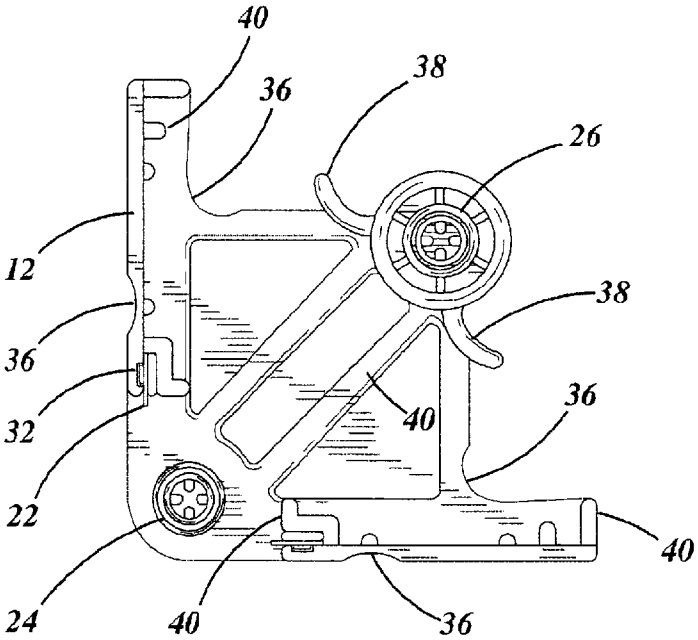
FIG. 7 is a front elevational view of the tape dispensing system of the type shown in FIG. 3 with the hub and application roller removed.
Figure 6:
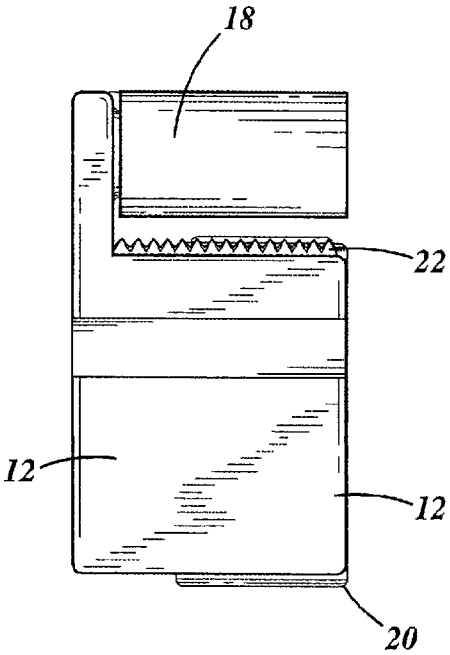
FIG. 6 is a side elevational view of the tape dispensing system of the type shown in FIG. 5 rotated 180 degrees about a rotation axis of the hub.
Figure 5:
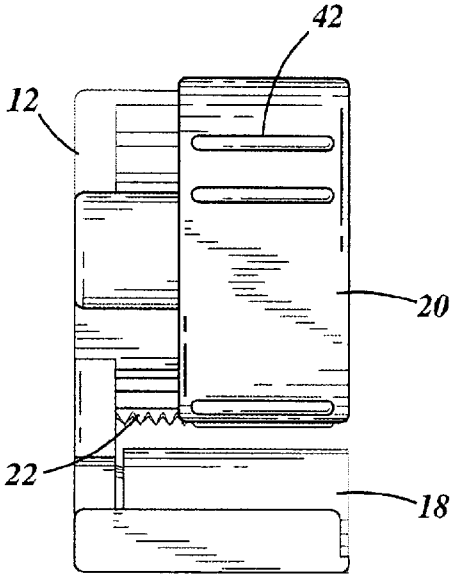
FIG. 5 is a side elevational view of the tape dispensing system of the present invention.
Figure 10:
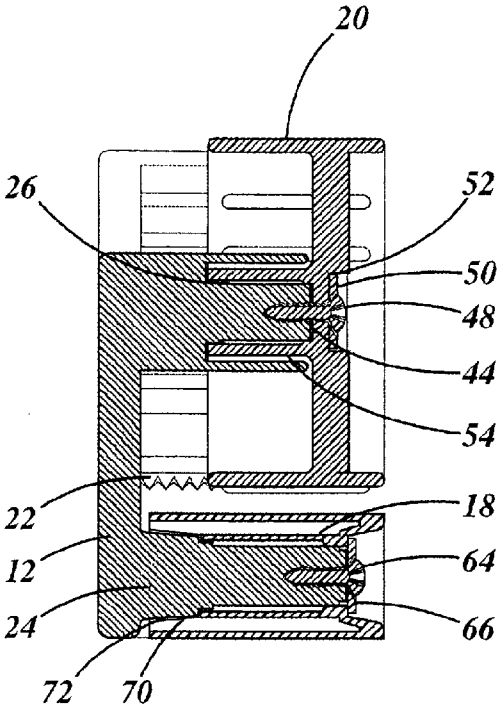
FIG. 10 is a partial sectional side elevational view of the tape dispensing system of the type shown in FIG. 5.

Referring first to FIG. 1 the tape-dispensing device 10 of the present invention is shown. The dispensing device 10 generally includes a frame 12, first alignment member 14, second alignment member 16, application roller 18, hub 20, and cutting members 22. The application roller 18 and hub 20, are preferably rotatably, removably attached to support members 24 and 26 as shown in FIGS. 2 and 10. The cutting members 22 are press fit into grooves 28 and 30 formed in alignment members 14 and 16 respectively. The grooves 28 and 30 further include a channel 32 formed therein and are adapted for receiving post 34 extending from a portion of the cutting member 22. The cutting members include a serrated edge and are of a known suitable construction.

Referring to FIGS. 3–7, the frame includes fingerholds 36 formed in the frame 12 and alignment members 14 and 16, and fingerholds or wing members 38 extending from the frame 12. The fingerholds 38 are well suited for positioning the middle and index fingers thereon, while resting the thumb and fifth finger in the fingerholds 36. The fingerholds 36 and 38 are positioned around the frame 12 in strategic positions to facilitate the handling and maneuvering of the device 10. The frame 12 may further include ribs 40 extending from planar surfaces of the frame 12 to provide added support and rigidity to the frame 12. The hub 20 includes ribs 42 extending outwardly from an outer circumferential surface of the hub 20. The ribs 42 are designed to engage an inside surface of a core of a tape role.

Figure 9:
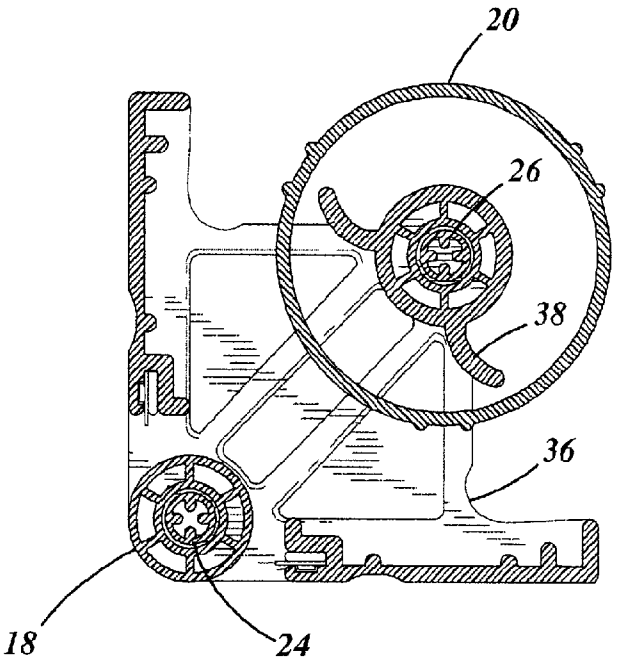
FIG. 9 is a front partial sectional view of the tape dispensing system of the type shown in FIG. 3.
Figure 8:
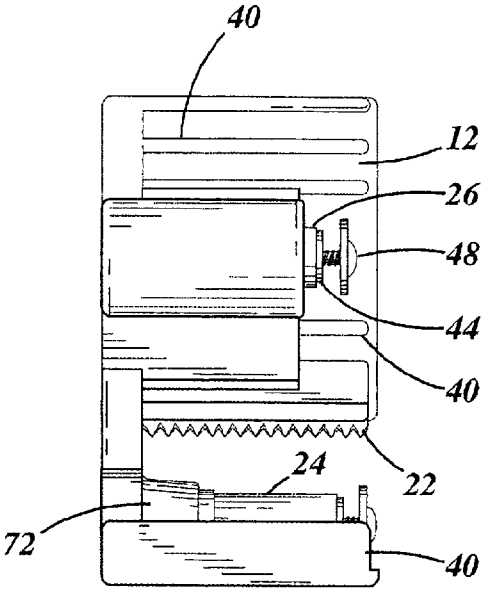
FIG. 8 is a side elevational view of the tape dispensing system of the type shown in FIG. 5 with the hub and application roller removed.

Without any limitation intended, the preferred mode of rotatably coupling the hub 20 and application roller 18 to the frame 12 is shown in greater detail in FIGS. 8–10. A tip 44 of the support member 26 extends through a bore 46 (see FIG. 2) formed in the hub 20. A screw 48 having a washer or extended shoulder 50 is engaged into the tip 44 of the support member 26 and tightened until the washer 50 engages against the tip 44. The hub 20 rotates or freely spins about support member 26 and the engaged screw 48 and washer 50 prevents the hub 20 from spinning off the support member 26. A bushing 54 of the hub 20 rotates about support member 26 and only an end portion of the bushing 54 contacts the support member 26, thereby reducing the amount of friction and/or wobble as the hub 20 rotates about the support member 26.

Similarly, a tip 60 of the support member 24 extends through a bore 62 (see FIG. 2) formed in the application roller 18. A screw 64 having a washer or extended shoulder 66 is engaged into the tip 60 of the support member 24 and tightened until the washer 66 engages against the tip 60. The application roller 18 rotates or freely spins about support member 24 and the engaged screw 64 and washer 66 prevents the application roller 18 from spinning off the support member 24. A bushing 6 of the application roller 18 rotates about support member 24 and only an end portion 70 of the bushing 68 contacts the support member 24, thereby reducing the amount of friction between the support member 24 and application roller 18. The end portion 70 of the application roller 18 is tapered to mirror a tapered portion 72 of the support member 24, to act as a positive locator reduce the amount of wobble as the application roller 18 rotates about the support member 24.

Figure 11:
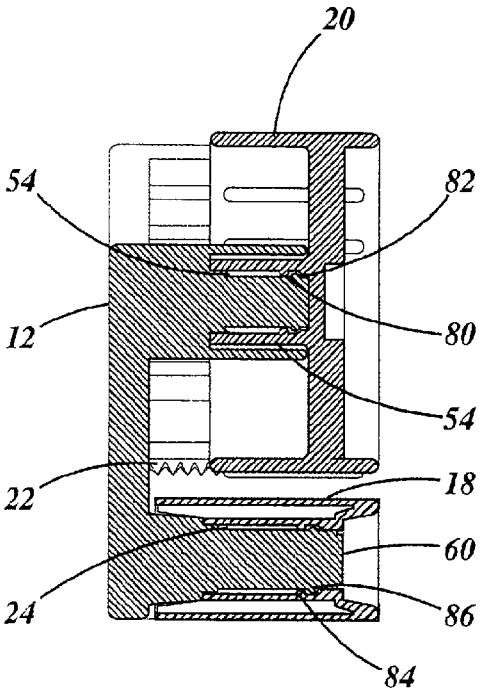
FIG. 11 is a partial sectional side elevational view of an alternate preferred embodiment of the tape dispensing system of the present invention.

Referring next to FIG. 11, an alternate preferred mode of coupling the hub 20 to support member 26 is shown. Rather than requiring a screw to engage the tip 44 of support member 26, a ridge 80 is formed on the inner surface of bushing 54. When the hub 20 is pressed onto the support member 26, the ridge 80 snaps over a lip 82 extending from the tip 44 of the support member 26. This snap fit then prevents the hub 20 from sliding off the support member 26 but allows free rotation of the hub 20 about the support member 26. Similarly, a ridge 84 is formed on the inner surface of bushing 68. When the application roller 18 is pressed onto the support member 24, the ridge 84 snaps over a lip 86 extending from the tip 60 of the support member 24. This snap fit then prevents the application roller 18 from sliding off the support member 24 but allows free rotation of the application roller 18 about the support member 24.

Figure 12:
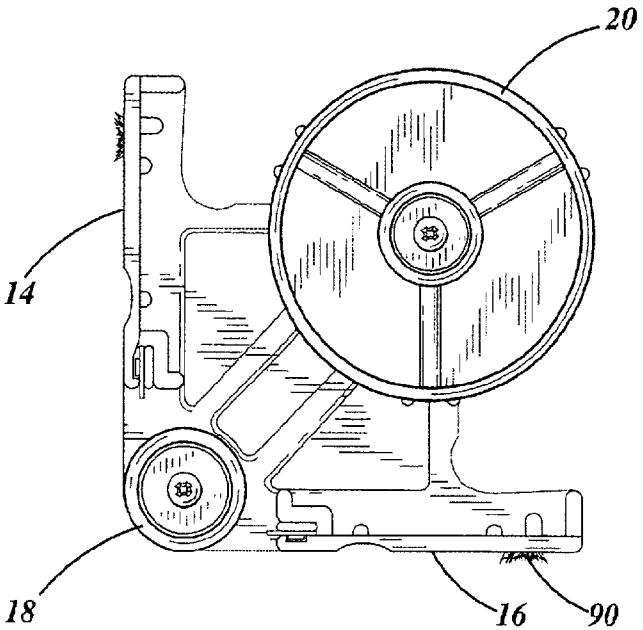
FIG. 12 is a front elevational view of an alternate preferred embodiment of the tape dispensing system of the present invention.

Referring to FIG. 12, soft flexible bristles 90 are shown extending from first and second alignment members 14 and 16. When tape is dispensed from the dispenser 10 provide added pressure against the tape, thereby promoting the adhesion of the tape to the underlying surface.

Figure 13:
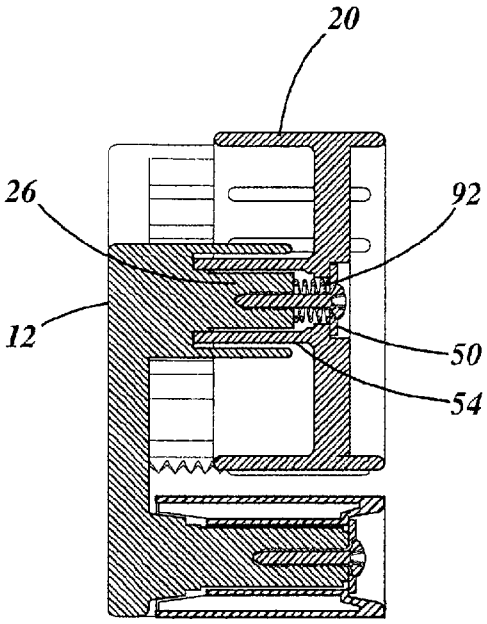
FIG. 13 is a partial sectional side elevational view of an alternate preferred embodiment of the tape dispensing system of the present invention.

FIG. 13 shows an alternate preferred mode of coupling the hub 20 to the support member 26. Rather than extending the tip 44 of the support member 26 through bore 46 a spring 92 is positioned between an end of the support member 26 and the washer 50. As the screw 48 is tightened, the spring compresses and the hub 20 moves inward. As the screw is loosened, the spring 92 elongates moving the hub 20 outward. This spring biasing arrangement allows for lateral movement of the hub 20 relative to the frame 12 and alignment members 14 and 16.

Figure 14:
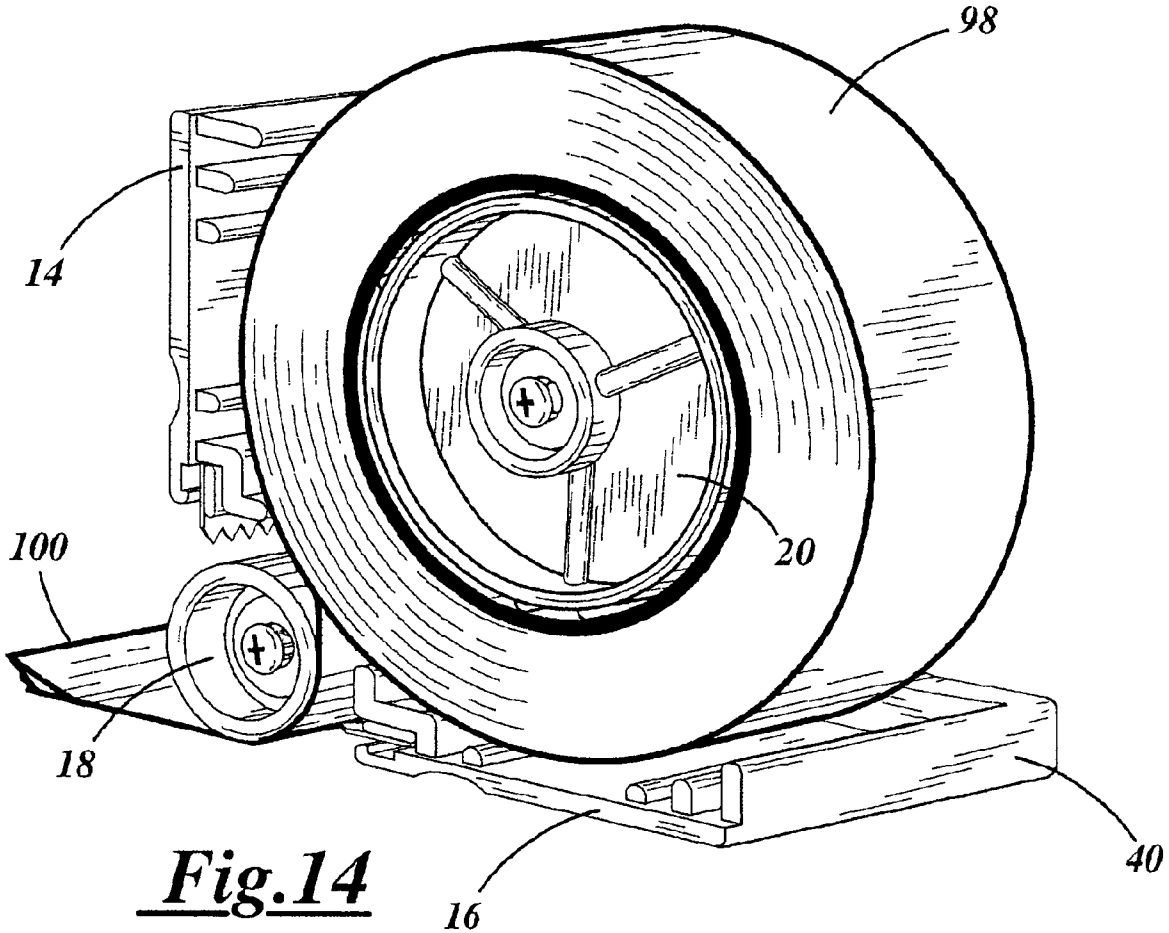
FIG. 14 is a front perspective view of the tape dispensing system of the present invention showing a roll of tape engaged to the hub and having the tape unrolled past the application roller.
Figure 16:
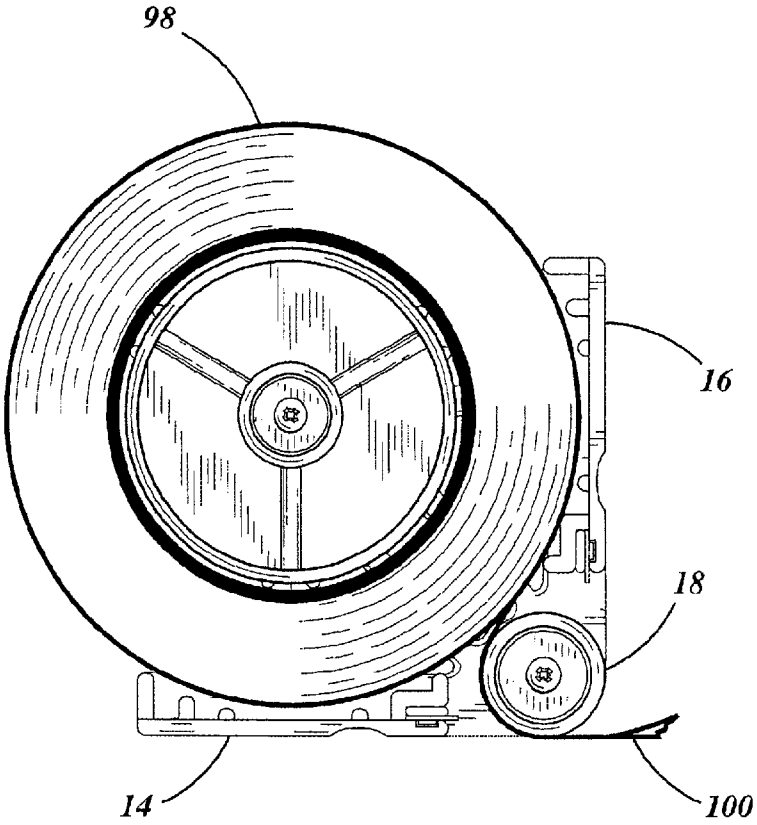
FIG. 16 is a front elevational view of the tape dispensing system of the present invention showing a roll of tape engaged to the hub and having the tape unrolled past the application roller for application of the tape in a left to right direction.
Figure 15:
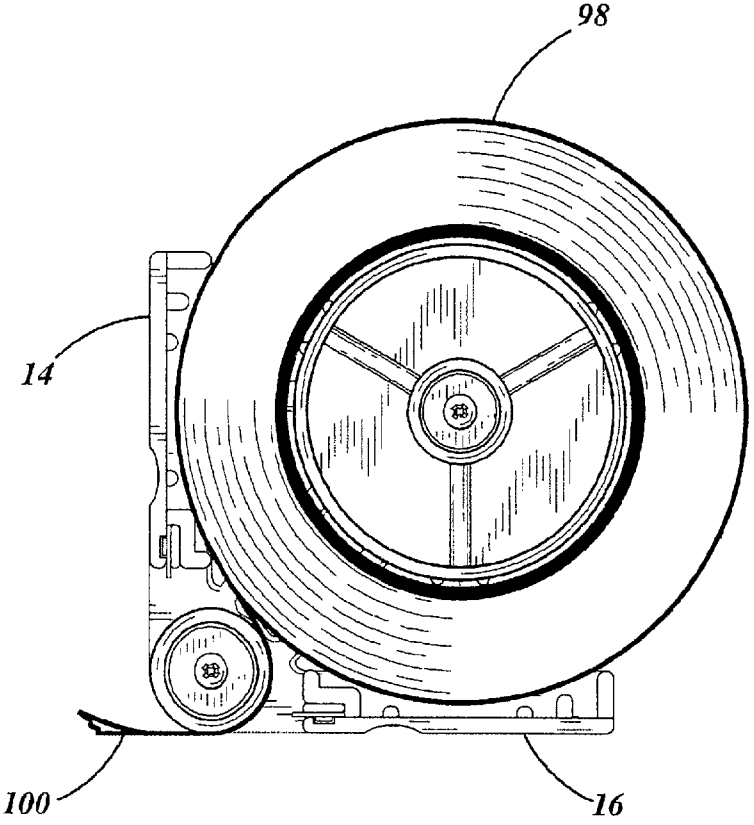
FIG. 15 is a front elevational view of the tape dispensing system of the present invention showing a roll of tape engaged to the hub and having the tape unrolled past the application roller for application of the tape in a right to left direction.
Figure 18:
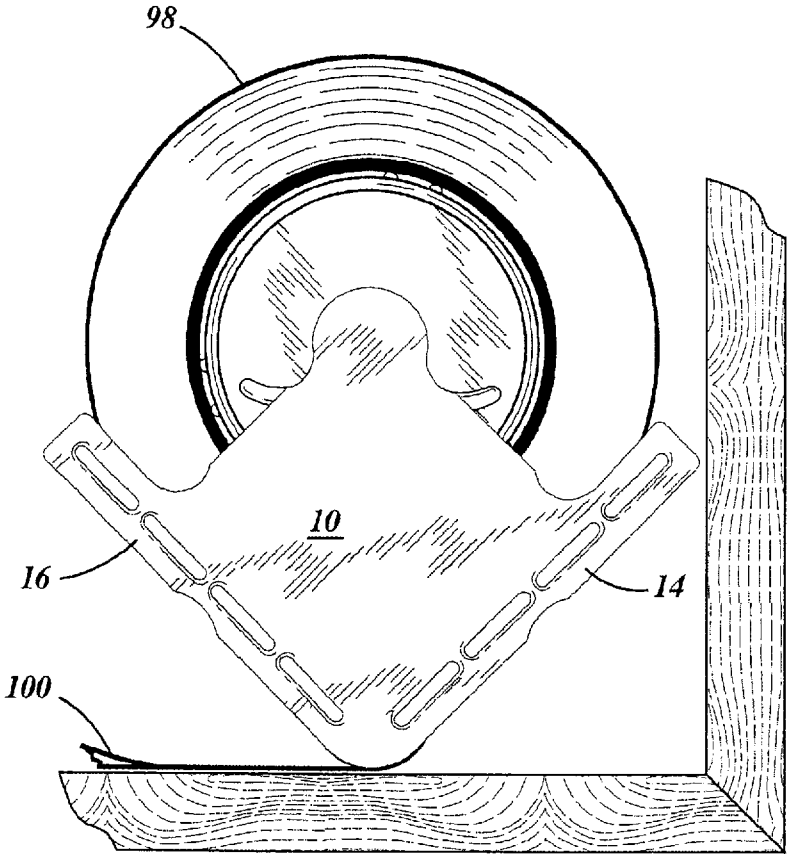
FIG. 18 is a back elevational view of the tape dispensing system of the type shown in FIG. 17, showing the dispenser being rotated.
Figure 17:
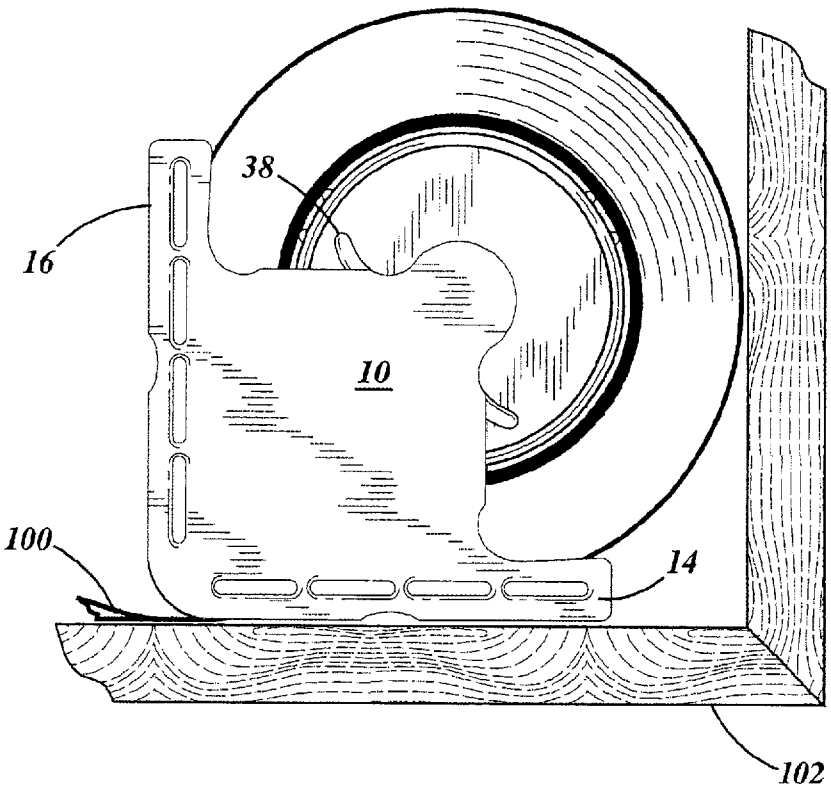
FIG. 17 is a back elevational view of the tape dispensing system of the type shown in FIG. 16 showing application of the tape in a left to right horizontal direction into a corner.
Figure 20:
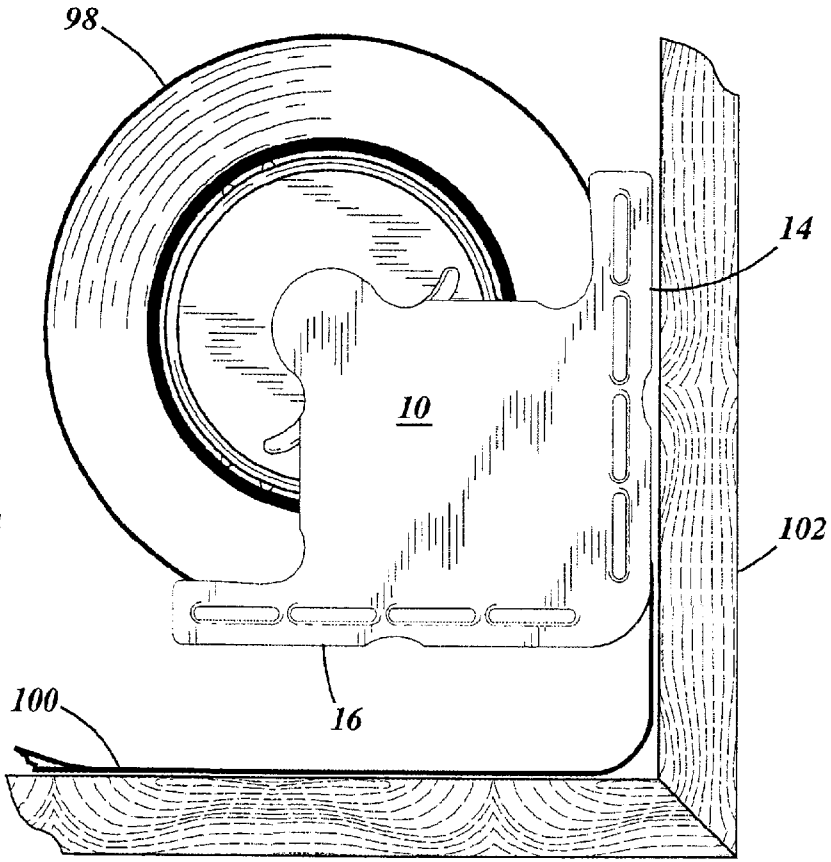
FIG. 20 is a back elevational view of the tape dispensing system of the type shown in FIG. 17 showing application of the tape in a left to right vertical direction away from the corner.
Figure 19:
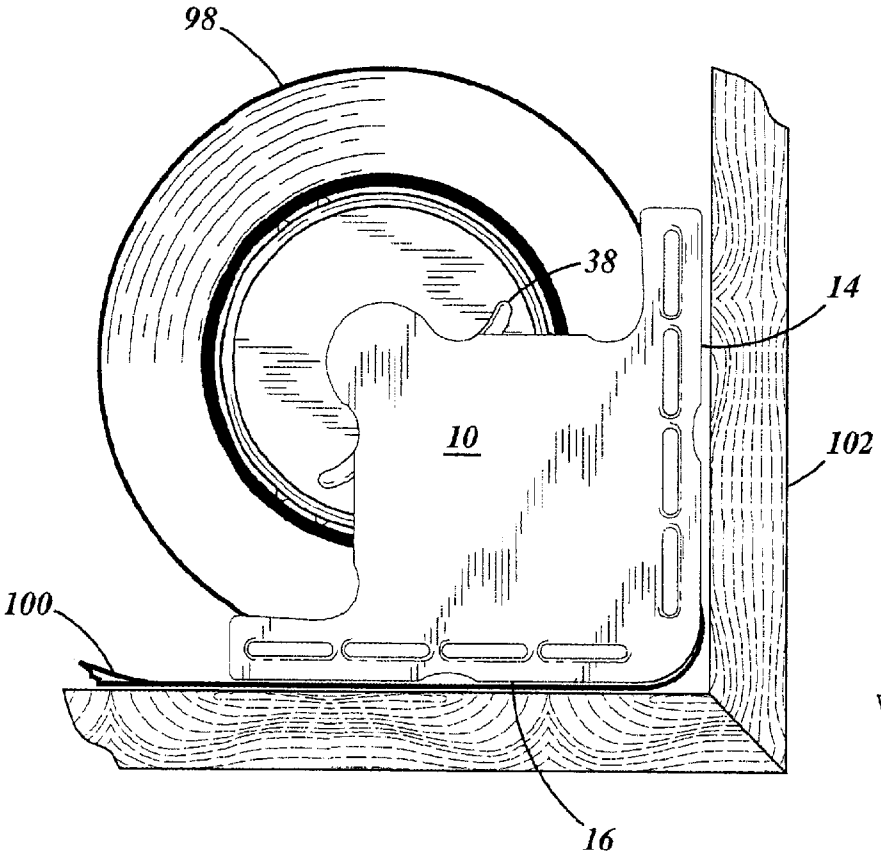
FIG. 19 is a back elevational view of the tape dispensing system of the type shown in FIG. 17, showing the dispenser being positioned in the corner after rotation.
Figure 22:
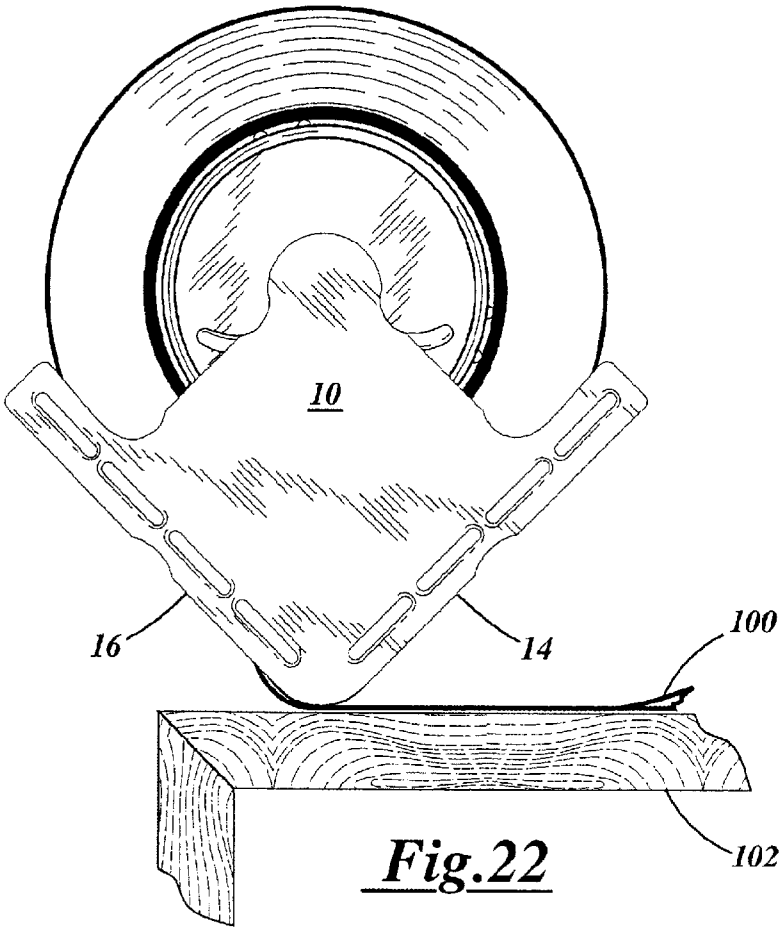
FIG. 22 is a back elevational view of the tape dispensing system of the type shown in FIG. 21, showing the dispenser being rotated.
Figure 21:
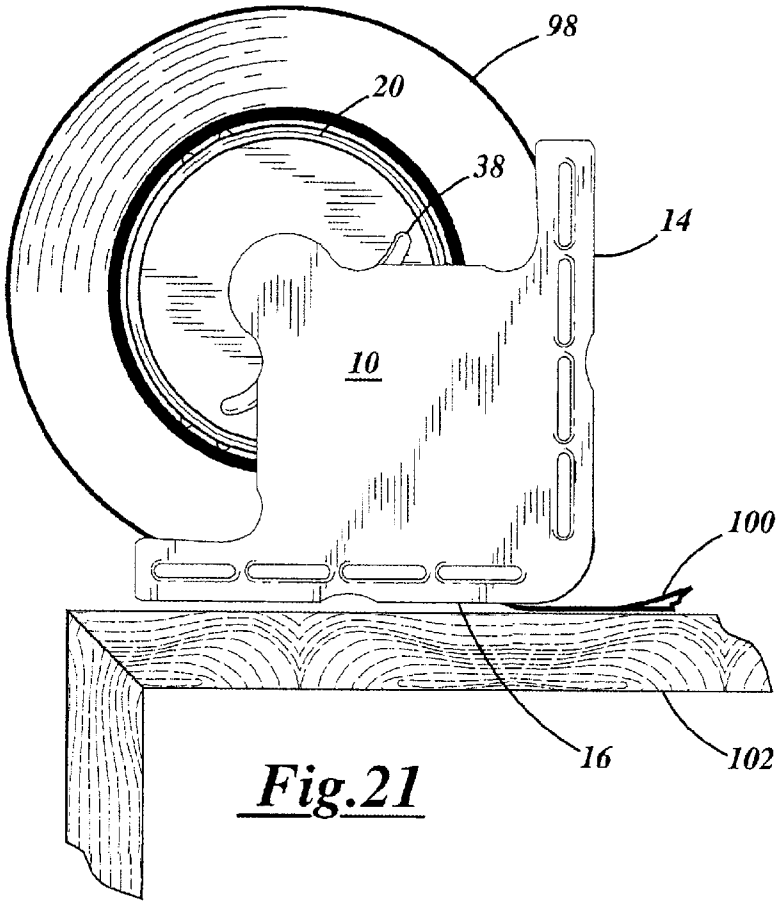
FIG. 21 is a back elevational view of the tape dispensing system of the type shown in FIG. 15 showing application of the tape in a right to left horizontal direction towards an edge or corner of a frame.
Figure 24:
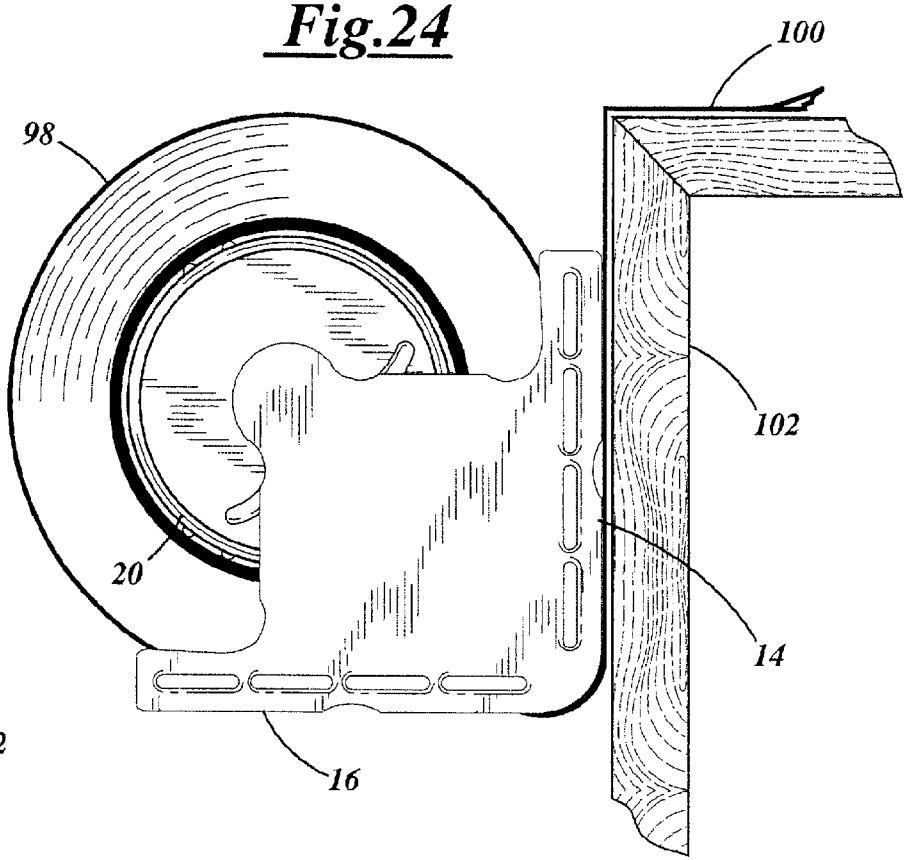
FIG. 24 is a back elevational view of the tape dispensing system of the type shown in FIG. 21 showing the dispenser rotated about the corner of the frame.
Figure 23:
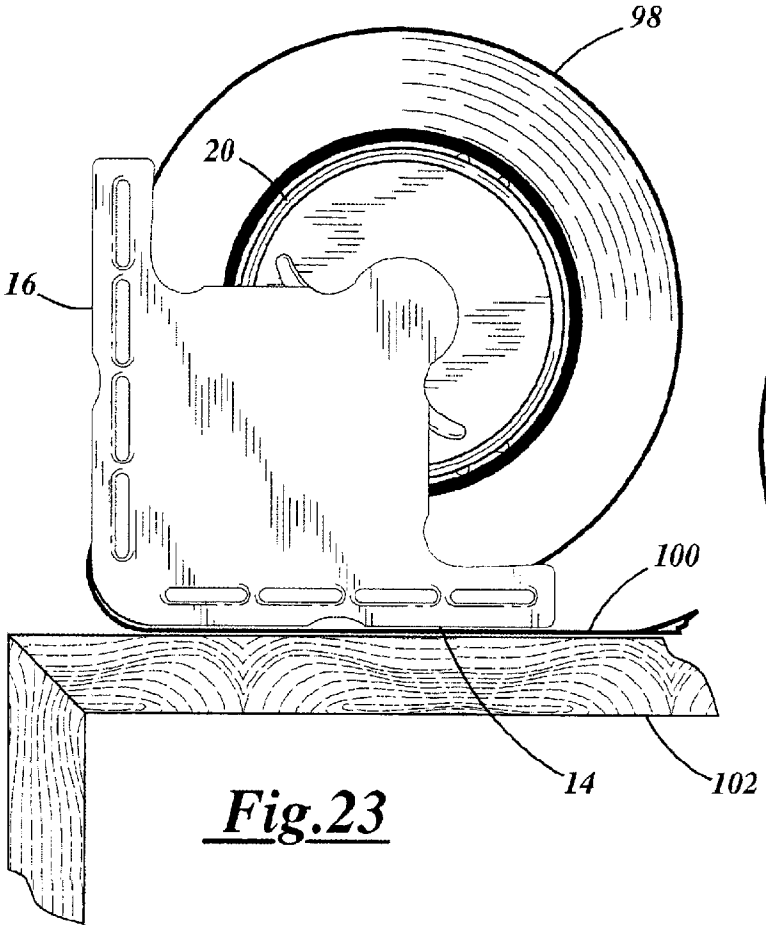
FIG. 23 is a back elevational view of the tape dispensing system of the type shown in FIG. 21, showing the dispenser being positioned adjacent the edge or corner of the frame after rotation.

Having described the constructional features of the present invention the mode of use will be described in greater detail in conjunction with a description of FIGS. 14–24. Referring first to FIGS. 14–16, a roll of tape 98 is shown press fit onto the hub 20 with the tape 100 being unrolled from the roll 98. The adhesive side of the tape 100 faces downward and the tape is threaded under the application roller 18. As described above, the edge of the tape aligns with one or more of the application roller 18 and alignment members 14 and 16. FIG. 15 shows the pathway of the tape through and out the dispenser when the tape 100 is applied to a baseboard and wall, for example, in a right to left direction. FIG. 16 shows the pathway of the tape 100 through and out the dispenser 10 when the tape 100 is applied to a baseboard and wall, for example, in a left to right direction.

Turning now to FIGS. 17–20, the application of tape 100 into the corner of a framework 102 is sequentially shown. The user first applies the tape in a left to right direction towards the corner (see FIG. 17). As the dispenser is moved into the corner of the framework the dispenser is rotated so that the alignment member 14 moves from a horizontal position to a vertical position (see FIG. 18). The user then presses the dispenser 10 into the corner (see FIG. 19) and then the dispenser is moved upward in the vertical direction along the framework. Those skilled in the art will appreciate that if an exact fit of the tape into the corner is desired, when the user presses the dispenser 10 into the corner (shown in FIG. 19) a utility knife may be positioned between the tape 100 and alignment member 16 and then slid into the corner, thereby pressing the tape 100 tight into the corner. Those skilled in the art will further appreciate that the radius of the application roller may be reduced to minimize the radius of the tape positioned in the corner.

Figure 25:
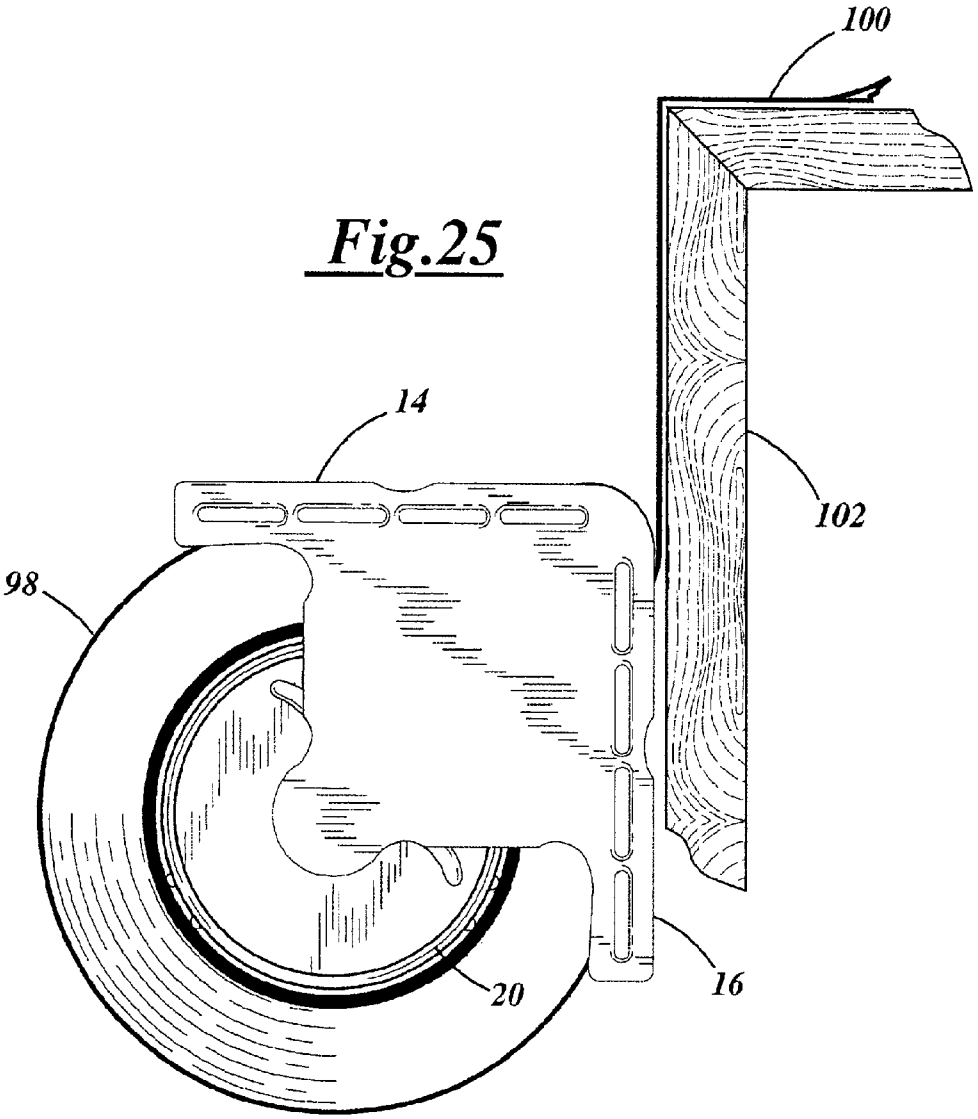
FIG. 25 is a back elevational view of the tape dispensing system of the type shown in FIG. 21 showing application of the tape in a right to left vertical direction away from the edge or corner of the frame and rotated ninety (90) degrees.

FIGS. 21–24 illustrates the sequential application of tape 100 around the corner of framework 102. The user first applies the tape in a right to left direction towards the corner (see FIG. 21). As the dispenser is moved towards the corner of the framework the dispenser is rotated so that the alignment member 14 moves from a vertical position to a horizontal position (see FIG. 22). The user then presses the dispenser 10 towards the edge (see FIG. 23) until only a portion of alignment member 14 overlaps with the framework 102. The dispenser 10 is then rotated downward around the corner and then the user moves the dispenser downward in the vertical direction along the framework (see FIG. 24). The user may again rotate the dispenser ninety (90) degrees so that the leading edge of alignment member 16 is adjacent the framework (see FIG. 25)

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A bi-directional tape dispensing device capable of applying tape around and into corners of a first surface, wherein the first surface may be adjacent to a second surface, said tape dispensing device comprising:

a frame having an alignment member extending from said frame;

a hub rotatably attached to said frame and adapted for receiving a roll of tape, wherein when the roll of tape is received by said hub, an outer edge of said tape aligns with an outer edge of said alignment member, and further wherein said roll of tape may be pressed onto said hub with the outer edge of said roll of tape being oriented on said bi-directional tape dispenser independent of a width of the roll of tape and with no dependency on an inner edge of said roll of tape.

2. The dispensing device as recited in claim 1 further including a second alignment member extending from said frame and spaced apart from said alignment member.

3. The dispensing device as recited in claim 2, wherein an angle between a longitudinal axis of said alignment member and a longitudinal axis of said second alignment member is less than ninety (90) degrees.

4. The dispensing device as recited in claim 1, further including a means for holding said dispensing device while dispensing tape therefrom.

5. The dispensing device as recited in claim 4, wherein said means for holding includes finger holds formed in said frame.

6. The dispensing device as recited in claim 1, further including a roller attached to said frame for guiding the tape as it is removed from the dispensing device.

7. The dispensing device as recited in claim 6, wherein said roller is rotatably attached to said frame.

8. The bi-directional tape dispensing device as recited in claim 6, wherein said edge of said roll of tape is further oriented relative to said roller.

9. The bi-directional tape dispensing device as recited in claim 6, wherein said edge of said roll of tape is further oriented relative to said roller by aligning said roll with said hub and pressing said edge of said roll of tape against a relatively planar surface until a portion of the application roller contacts the relatively planar surface.

10. The dispensing device as recited in claim 1, further including bristles attached to said frame, wherein said bristles apply pressure to the tape as it is being dispensed from said dispensing device.

11. The dispensing device as recited in claim 1, wherein said hub includes a spring biasing member coupled to said hub for lateral movement of said hub relative to a longitudinal axis of said alignment member.

12. The dispensing device as recited in claim 1, further including a means for adjusting an alignment of an outer edge of said hub relative to an outer edge of said alignment member.

13. The dispensing device as recited in claim 1, further including a removable cutting member for cutting the tape as it is dispensed from said dispensing device.

14. The dispensing device as recited in claim 13, wherein said cutting member is press fit into a groove formed in an end of said alignment member.

15. The dispensing device as recited in claim 1, wherein said frame is made from a high impact thermal moldable plastic.

16. The dispensing device as recited in claim 1, wherein said frame includes reinforcement ribs extending from said frame.

17. The bi-directional tape dispensing device as recited in claim 1, wherein said edge of said roll of tape is oriented relative to said alignment member.

18. The bi-directional tape dispensing device as recited in claim 1, wherein said edge of said roll of tape is oriented relative to said frame.

19. The bi-directional tape dispensing device as recited in claim 1, wherein said edge of said roll of tape is oriented relative to said alignment member by aligning said roll with said hub and pressing said edge of said roll of tape against a relatively planar surface until a portion of the alignment member contacts the relatively planar surface.

20. The bi-directional tape dispensing device as recited in claim 1, wherein said edge of said roll of tape is oriented relative to said frame by aligning said roll with said hub and pressing said edge of said roll of tape against a relatively planar surface until a portion of the frame contacts the relatively planar surface.

21. A bi-directional tape dispensing device capable of applying tape around and into corners of a first surface that is positioned adjacent to a second surface, said tape dispensing device comprising:

a frame having first and second spaced apart alignment members, wherein said first and second alignment members are positioned on said frame relative to a common point and having a pre-defined angle between the first and second alignment members and the common point; and a hub rotatably attached to said frame and adapted for receiving a roll of tape, wherein an outer edge of the roll of tape aligns with an outer edge of each of said first and second alignment members, wherein alignment of said outer edge of the roll with said first and second alignment members is made with no dependency on an inner edge of the roll of tape, whereby tape passes between said first and second alignment members as tape is dispensed from the roll of tape.

22. The dispensing device as recited in claim 21, further including a means for holding said dispensing device while dispensing tape therefrom.

23. The dispensing device as recited in claim 22, wherein said means for holding includes finger holds formed in said frame.

24. The dispensing device as recited in claim 21, further including a roller attached to said frame relative to the common point for guiding the tape as it is removed from the roll of tape.

25. The dispensing device as recited in claim 24, wherein said roller is rotatably attached to said frame.

26. The dispensing device as recited in claim 21, further including bristles attached to said frame, wherein said bristles apply pressure to tape as it is being dispensed from the roll of tape.

27. The dispensing device as recited in claim 21, wherein said hub includes a spring biasing member coupled to said hub to thereby provide lateral movement of said hub relative to an axis of said alignment member.

28. The dispensing device as recited in claim 21, further including a means for adjusting an alignment of an outer edge of said hub relative to an outer edge of said alignment member.

29. The dispensing device as recited in claim 21, further including a removable cutting member for cutting tape as it is dispensed from said dispensing device.

30. The dispensing device as recited in claim 29, wherein said cutting member is press fit into a groove formed in an end of said alignment member.

31. The dispensing device as recited in claim 21, wherein said frame is made from a high impact thermal moldable plastic.

32. The dispensing device as recited in claim 21, wherein said frame includes reinforcement ribs extending from said frame.

33. The dispensing device as recited in claim 21, wherein the angle between said first and second alignment members and the common point is less than ninety (90) degrees.

34. The dispensing device as recited in claim 21, wherein said roll of tape may be pressed onto the hub with an end of said tape being oriented relative to either the first or second alignment member.

* * * * *